US008893336B2

(12) United States Patent
Hsu

(10) Patent No.: US 8,893,336 B2
(45) Date of Patent: Nov. 25, 2014

(54) METHOD FOR AUTOMATICALLY ADJUSTING HARDNESS OF MATTRESS BASED ON OPERATOR'S LYING POSITION OR OPERATOR'S SIDE LYING POSITION AND DEVICE THEREOF

(76) Inventor: Han-Chung Hsu, Taipei (TW)

( * ) Notice: Subject to any disclaimer, the term of this patent is extended or adjusted under 35 U.S.C. 154(b) by 243 days.

(21) Appl. No.: 13/315,328

(22) Filed: Dec. 9, 2011

(65) Prior Publication Data

US 2013/0145557 A1 Jun. 13, 2013

(51) Int. Cl.
*A47C 17/00* (2006.01)

(52) U.S. Cl.
USPC ..... 5/690; 5/697; 5/716; 5/727

(58) Field of Classification Search
USPC ..... 5/690, 697, 716, 727, 936; 267/170, 267/177
See application file for complete search history.

(56) References Cited

U.S. PATENT DOCUMENTS

| | | | | |
|---|---|---|---|---|
| 7,596,823 | B2 * | 10/2009 | Friedrichs | 5/713 |
| 7,934,277 | B1 | 5/2011 | Hsu | |
| 2010/0101026 | A1 * | 4/2010 | Papaioannou | 5/710 |

* cited by examiner

*Primary Examiner* — Brittany Wilson
(74) *Attorney, Agent, or Firm* — Ming Chow; Sinorica, LLC

(57) ABSTRACT

A method for automatically adjusting the hardness of a mattress based on an operator's lying position or an operator's side lying position and a device are disclosed. The device comprises: a base, having hollow platforms that have support legs; a lifting device, below the hollow platforms; a mattress body, disposed on the base and comprising a bed surface, a bed bottom, flexible support units, and gravity sensors, through holes being disposed in the bed bottom and corresponding to the lifting device, the flexible support unit being constructed by a first flexible member female-connected with a second flexible member; and a control device, connected with the lifting device and the gravity sensors, wherein the control device determines that the touching number of the gravity sensors is greater, equal to or less than a preset value and therefore automatically adjusts the hardness of the mattress.

8 Claims, 5 Drawing Sheets

METHOD FOR AUTOMATICALLY ADJUSTING HARDNESS OF MATTRESS BASED ON OPERATOR'S LYING POSITION OR OPERATOR'S SIDE LYING POSITION AND DEVICE THEREOF

BACKGROUND OF THE INVENTION

1. Field of the Invention

The present invention is a method for automatically adjusting the hardness of a mattress based on an operator's lying position or an operator's side lying position and a device thereof, more particularly to a device that can determine the operator is in which position in order to automatically adjust the hardness of the mattress.

2. Description of the Prior Art

Under the leadership of science and technology, the life is always fast and in pressure. At the end of a day, everybody needs a good sleep to completely relax the body for the next day.

Except for work and normal life, 30% time is for sleep for a human being. The quality of a sleep may directly affect the health of the human being. Accordingly, demands to a mattress may then be more than ever. The prior mattresses are mostly made by the way of integration molding, and the softness of a mattress shall be adjusted based on the requirements of a user. It costs a lot as always and is inconvenient. The prior mattress structure has a mattress body and a flexible member in the mattress body, but it is full of disadvantages listed below:

1. After using a period of time, partial of the flexible member is damaged as a sunken portion so as to affect sleep.
2. The flexibility of each part of the surface of the prior mattress structure is the same and may not be changed; the flexibility cannot be adjusted according to different users as well.
3. Since the flexible member is made by integration molding, a chain reaction can happen. If two people with different sleep habits lie on a bed, one people may be affected by another. Hence, an option for solving the problem is to purchase another mattress structure for more comfortable, but it is definitely not an economic way.

The inventor of the present invention had applied a patent application, titled mattress structure, to USPTO on Sep. 8, 2010, and the application number is Ser. No. 12/877,275. The patent application is to adjust the hardness of the mattress, but there are different positions while in sleep, such as an operator's lying position or an operator's side lying position, and different positions are corresponding to different types of hardness. Hence, the present invention is able to automatically adjust the hardness of the mattress based on different positions and the prior patent application.

SUMMARY OF THE INVENTION

The main objective of the present invention is to provide a method for automatically adjusting the hardness of a mattress based on an operator's lying position or an operator's side lying position and a device thereof, wherein the operator in which position is determined through that a control device concludes the touching number of gravity sensors is greater, equal to or less than a preset value, and the hardness of the mattress is automatically adjusted according to the conclusion.

To approach the objective of the present invention, the device for automatically adjusting the hardness of the mattress based on the operator's lying position or the operator's side lying position comprises a mattress body that is adjustable for hardness thereof, and the mattress body is disposed a plurality of gravity sensors, the gravity sensors are transversely positioned in the mattress body. The plurality of gravity sensors are electrically connected with a control device, and the control device determines whether the touching number of the gravity sensors is greater, equal to or less than a preset value or not, and automatically adjusts the hardness of the mattress body to the adjusting value of the operator's lying position or the operator's side lying position.

Practically, the gravity sensors transversely positioned in the mattress body is from the left to right or the right to left of the mattress where the operator is lying on.

A device for automatically adjusting the hardness of a mattress based on the operator's lying position or the operator's side lying position comprises: a base, having a plurality of hollow platforms that have a plurality of support legs; a lifting device, below the hollow platforms of the base; a mattress body, disposed on the base and comprising a bed surface, a bed bottom, a plurality of flexible support units, and a plurality of gravity sensors, a plurality of through holes being disposed in the bed bottom and corresponding to the lifting device, the flexible support unit being constructed by a first flexible member female-connected with a second flexible member, the two ends of the first flexible member being urged to the bed surface and the bed bottom, the second flexible member being free to go into and get out from the through hole of the bed bottom and being supported by the lifting device, the plurality of gravity sensors being transversely arranged on the top of one of the first flexible members, wherein the first flexible members are arranged transversely; and a control device, connected with the lifting device and the plurality of gravity sensors, wherein the control device determines whether the touching number of the gravity sensors is greater, equal to or less than a preset value or not and judges an operator is on his lying position or side lying position, therefore automatically drives the lifting device to an upper preset position or a lower preset position, the second flexible member being variable for flexibility according to the position of the lifting device so as to have different flexibilities of the operator's lying position or operator's side lying position.

Practically, the second flexible member of the mattress body has a fixing end and an active end, the fixing end being connected with the top of the first flexible member, the active end being corresponding to the through hole, the second flexible member protruding out the bed bottom through the through hole while the bed surface is pressing down.

Practically, the first flexible member and the second flexible member are wrapped around by a cover layer, the cover layer being made of nonwoven cloth in order to fasten the top of the first flexible member and the fixing end of the second flexible member.

Practically, the lifting device comprises a lifting platform and a power output component, the power output component being able to lift up or lower down the lifting platform, the lifting device being below the mattress body in order to let the lifting platform and the bed bottom of the mattress body be corresponding to each other, hence the second flexible member is supported by the lifting platform immediately while the second flexible member is protruding out the bed bottom.

Practically, the gravity sensor is a membrane switch or a pressure switch.

Practically, the control device at least comprises an operating interface, a central process unit, a display interface, a memory unit, an activating circuit, and a power supply unit, the power supply unit providing all power the control device needs for regular operations, the central process unit being electrically connected with the operating interface, the gravity sensors, the activating circuit, and the memory unit, the activating circuit being electrically connected with the power output component of the lifting device, through the determination of the central process unit, the result of the gravity sensors greater, equal to or less than the preset value being made, hence the operator is on his lying position or side lying position is determined so as to make the activating circuit drive the lifting device up or down.

Practically, the control device is integrated in a remote control, which is electrically connected with the gravity sensors, the lifting device and a height sensor via wire or wireless for signal transmission.

Practically, the present invention further comprises a height sensor, which is disposed between the lifting platform and the hollow platforms of the base in order to detect the distance of the lifting platform moving up or down and transmit a detect result to the control device.

Other and further features, advantages, and benefits of the invention will become apparent in the following description taken in conjunction with the following drawings. It is to be understood that the foregoing general description and following detailed description are exemplary and explanatory but are not to be restrictive of the invention. The accompanying drawings are incorporated in and constitute a part of this application and, together with the description, serve to explain the principles of the invention in general terms. Like numerals refer to like parts throughout the disclosure.

BRIEF DESCRIPTION OF THE DRAWINGS

The objects, spirits, and advantages of the preferred embodiments of the present invention will be readily understood by the accompanying drawings and detailed descriptions, wherein.

DETAILED DESCRIPTION OF THE INVENTION

Following preferred embodiments and figures will be described in detail so as to achieve aforesaid objects.

The present invention provides a method for automatically adjusting the hardness of a mattress based on an operator's lying position or an operator's side lying position and a device thereof. That is, the hardness of a mattress is preset according to an operator's lying or side lying position on a mattress body so as to acquire an adjusting value for a lying or side lying position. The mattress body is disposed a plurality of gravity sensors, the gravity sensors transversely positioned in the mattress body is from the left to right or the right to left of the mattress where the operator is lying on. The plurality of gravity sensors are electrically connected with a control device, and the control device 5 determines whether the touching number of the gravity sensors is greater, equal to or less than a preset value or not, and automatically adjusts the hardness of the mattress body to the adjusting value of the operator's lying position or the operator's side lying position.

Figure 1:
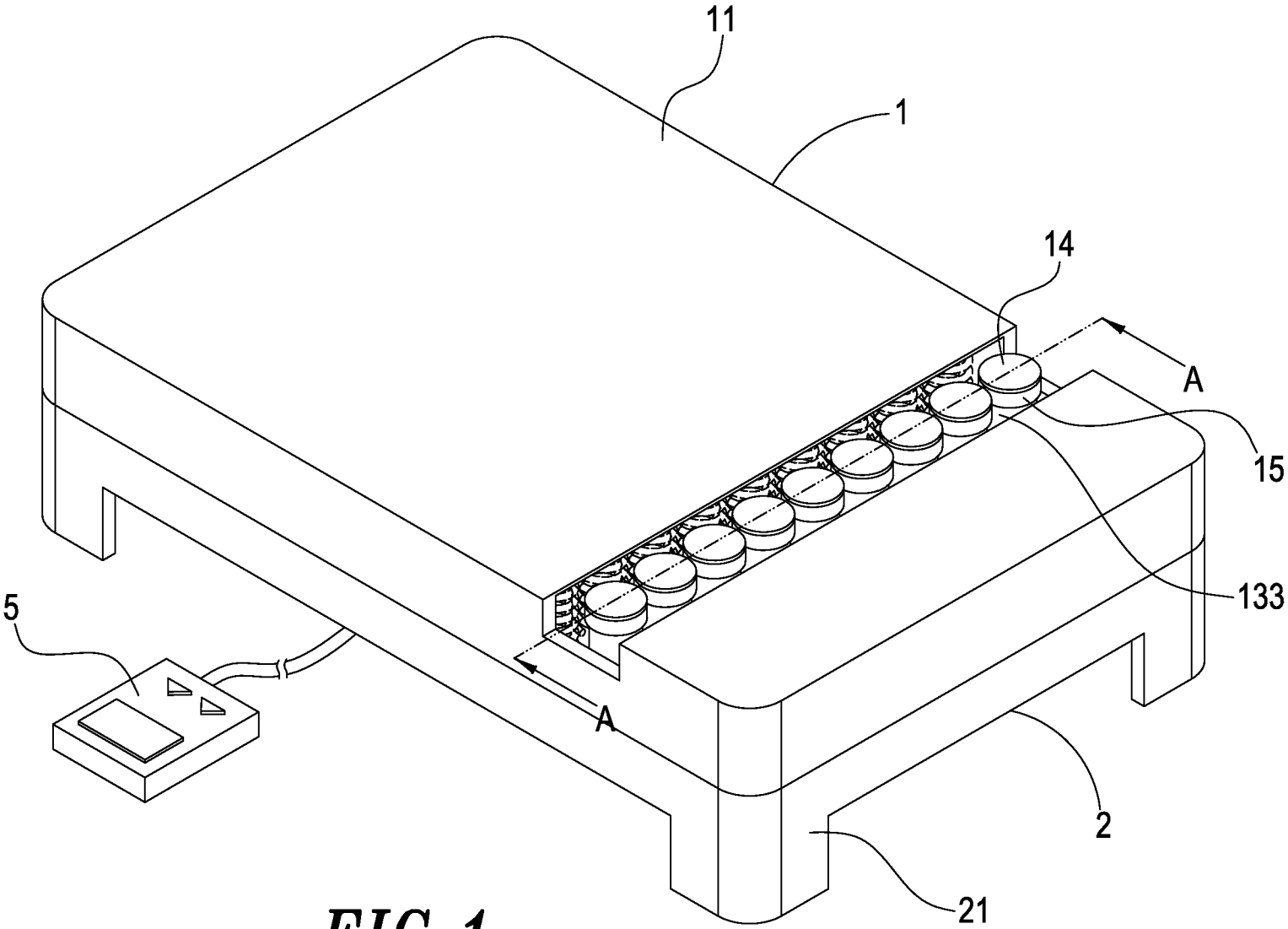
FIG. 1 illustrates a schematic 3-D view of the method for automatically adjusting the hardness of the mattress based on an operator's lying position or an operator's side lying position and the device thereof of the present invention.
Figure 2:
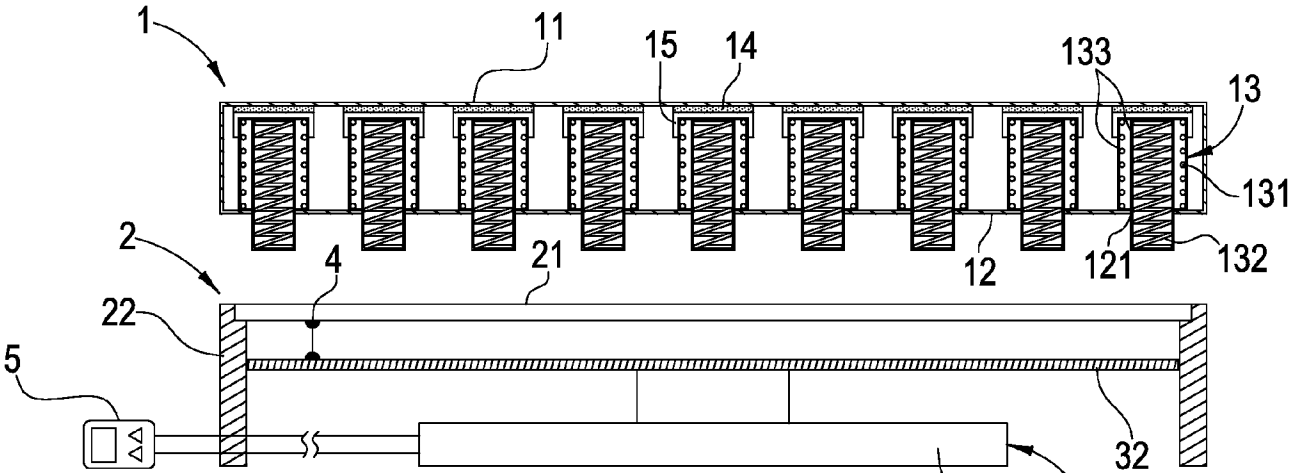
FIG. 2 illustrates a schematic lateral view of the method for automatically adjusting the hardness of the mattress based on an operator's lying position or an operator's side lying position and the device thereof of the present invention.
Figure 3:
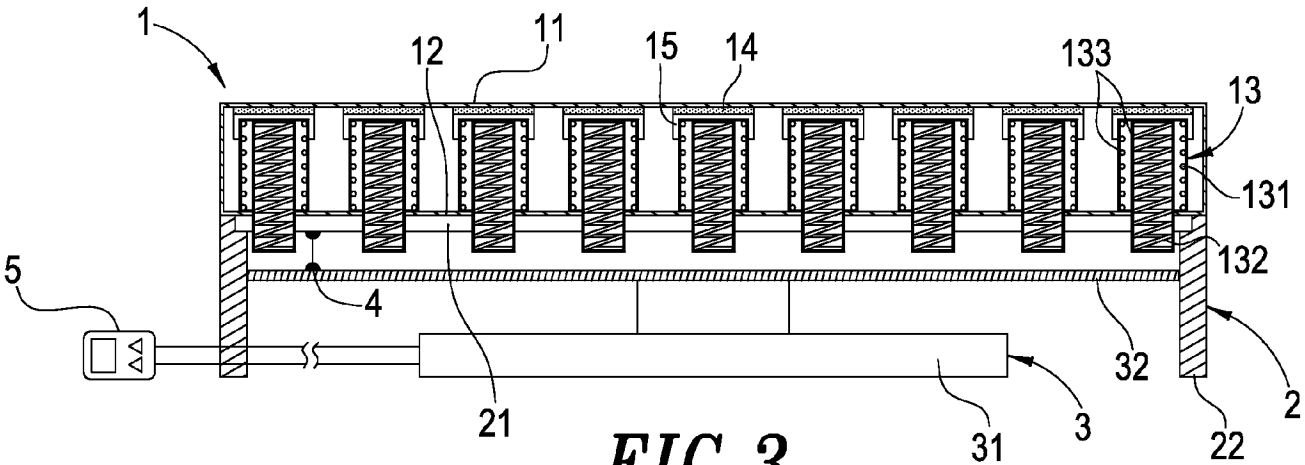
FIG. 3 illustrates a schematic lateral view of the method for automatically adjusting the hardness of the mattress based on an operator's lying position or an operator's side lying position and the device thereof of the present invention.

With references to FIG. 1, FIG. 2 and FIG. 3, the present invention, titled a method for automatically adjusting the hardness of a mattress based on a operator's lying position or a operator's side lying position and a device thereof, includes:

a mattress body 1 that has a bed surface 11, a bed bottom 12, a plurality of flexible support units 13, and a plurality of gravity sensors 14, wherein a plurality of through holes 121 are disposed in the bed bottom 12, the flexible support unit 13 is constructed by a first flexible member 131 and a second flexible member 132, the second flexible member 132 is accommodated in the first flexible member 131, the two ends of the first flexible member 131 are urged to the bed surface 11 and the bed bottom 12, so that the first flexible member 131 is positioned, the second flexible member 132 has a fixing end and an active end, the fixing end is connected with the top of the first flexible member 131, the active end is corresponding to the through hole 121, the second flexible member 132 is protruding out the bed bottom 12 through the through hole 121 while the bed surface 11 is pressing down, the top of one of the first flexible member 131 transversely arranged is connected with a positioning cover 15, and the positioning cover 15 is combined with the gravity sensors 14, the first flexible member 131 transversely positioned is from the left to right or the right to left of the mattress where the operator is lying on;

a base 2, which has a plurality of hollow platforms 21 that have a plurality of support legs 22 in order to support the hollow platforms 21 in a certain level, and the bed bottom 12 of the mattress body 1 can be disposed on the hollow platforms 21 for supporting the mattress body 1;

a lifting device 3, which has a lifting platform 31 and a power output component 32, the power output component 32 is able to lift up or lower down the lifting platform 31, the lifting device 3 is below the mattress body 1 in order to let the lifting platform 31 and the bed bottom 12 of the mattress body 1 are corresponding to each other, hence the second flexible member 132 is supported by the lifting platform 31 immediately while the second flexible member 132 is protruding out the bed bottom 12;

a height sensor 4, which is disposed between the lifting platform 31 and the hollow platforms 21 of the base 2 in order to detect the lifting platform 31 moving up or down;

a control device 5, which is connected with the lifting device 3 and the plurality of gravity sensors 4, wherein the control device 5 determines whether the touching number of the gravity sensors 14 is greater, equal to or less than a preset value or not and judges an operator is on his lying position or side lying position, therefore automatically drives the lifting device 3 to an upper preset position or a lower preset position, the second flexible member 132 is variable for flexibility according to the position of the lifting device 3 so as to have different flexibilities of the operator's lying position or operator's side lying position, that is, the hardness can be adjusted to a best mode in order to fit the needs of any operator.

The gravity sensor 14 is a membrane switch, a pressure switch or other gravity detection components, and it is not restricted hereinafter.

The first flexible member 131 and the second flexible member 132 are wrapped around by a cover layer 133, the cover layer 133 is made of nonwoven cloth in order to fasten the top of the first flexible member 131 and the fixing end of the second flexible member 132.

The fixing end of the second flexible member 132 is also fastened to the surface of the lifting platform 31 of the lifting device 3. The through hole 121 of the bed bottom 12, the first flexible member 131 and the active end are corresponding to each other. The second flexible member 132 goes into the first flexible member 131 through the through hole 121 of the bed bottom 12 and the mattress body 1 while the lifting platform 31 goes up.

Figure 4:
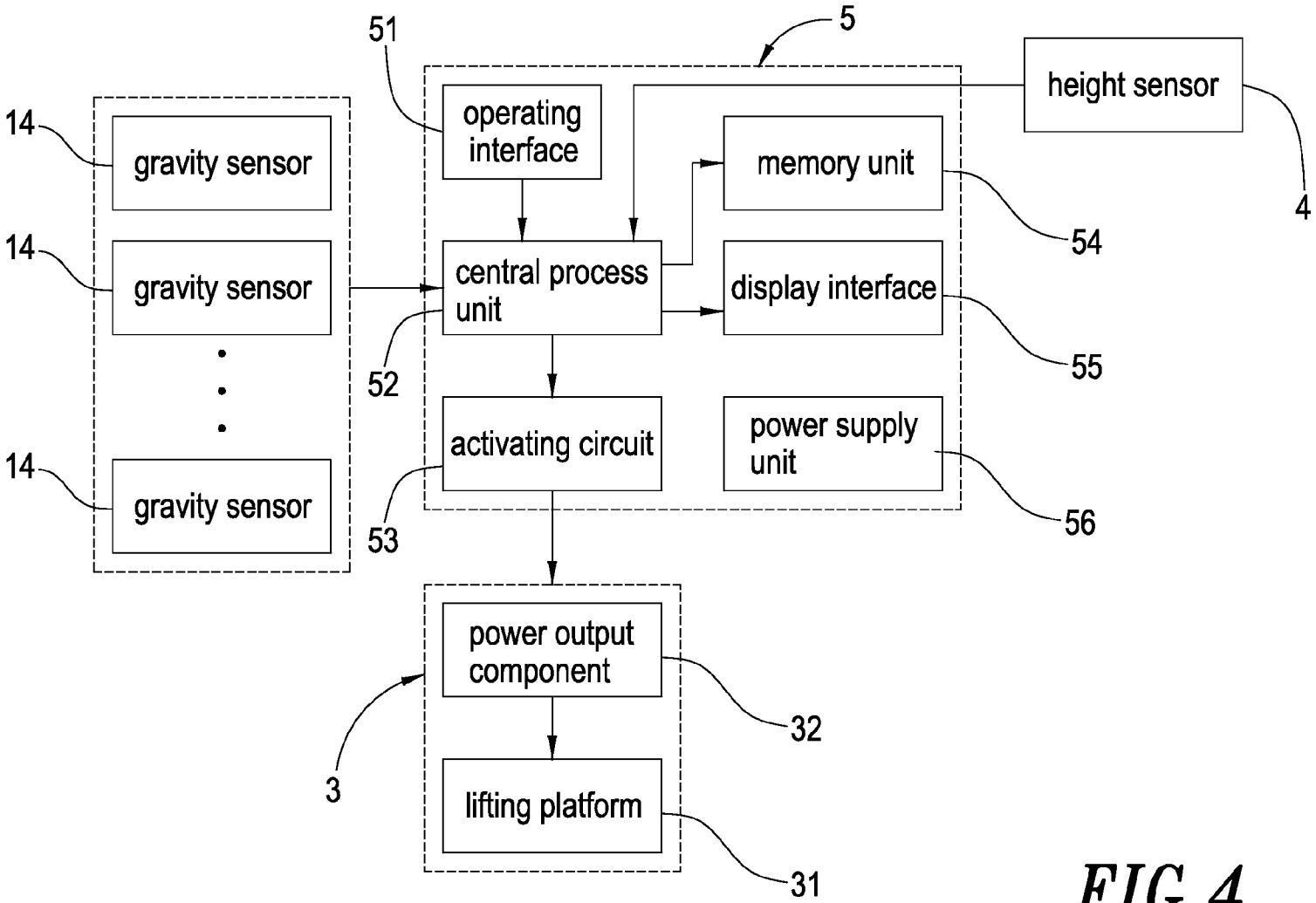
FIG. 4 illustrates a schematic block view of the method for automatically adjusting the hardness of the mattress based on an operator's lying position or an operator's side lying position and the device thereof of the present invention.
Figure 5:
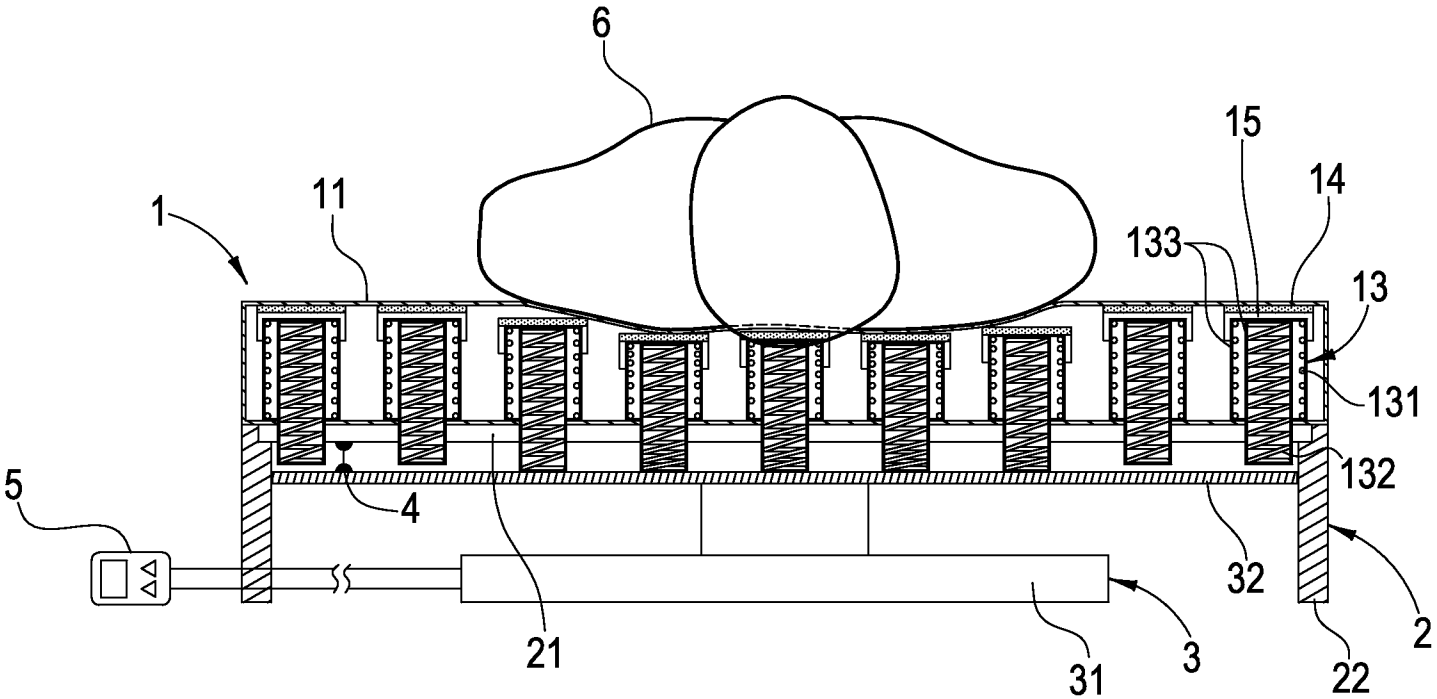
FIG. 5 illustrates a schematic operating view of the method for automatically adjusting the hardness of the mattress based on an operator's lying position or an operator's side lying position and the device thereof of the present invention.
Figure 6:
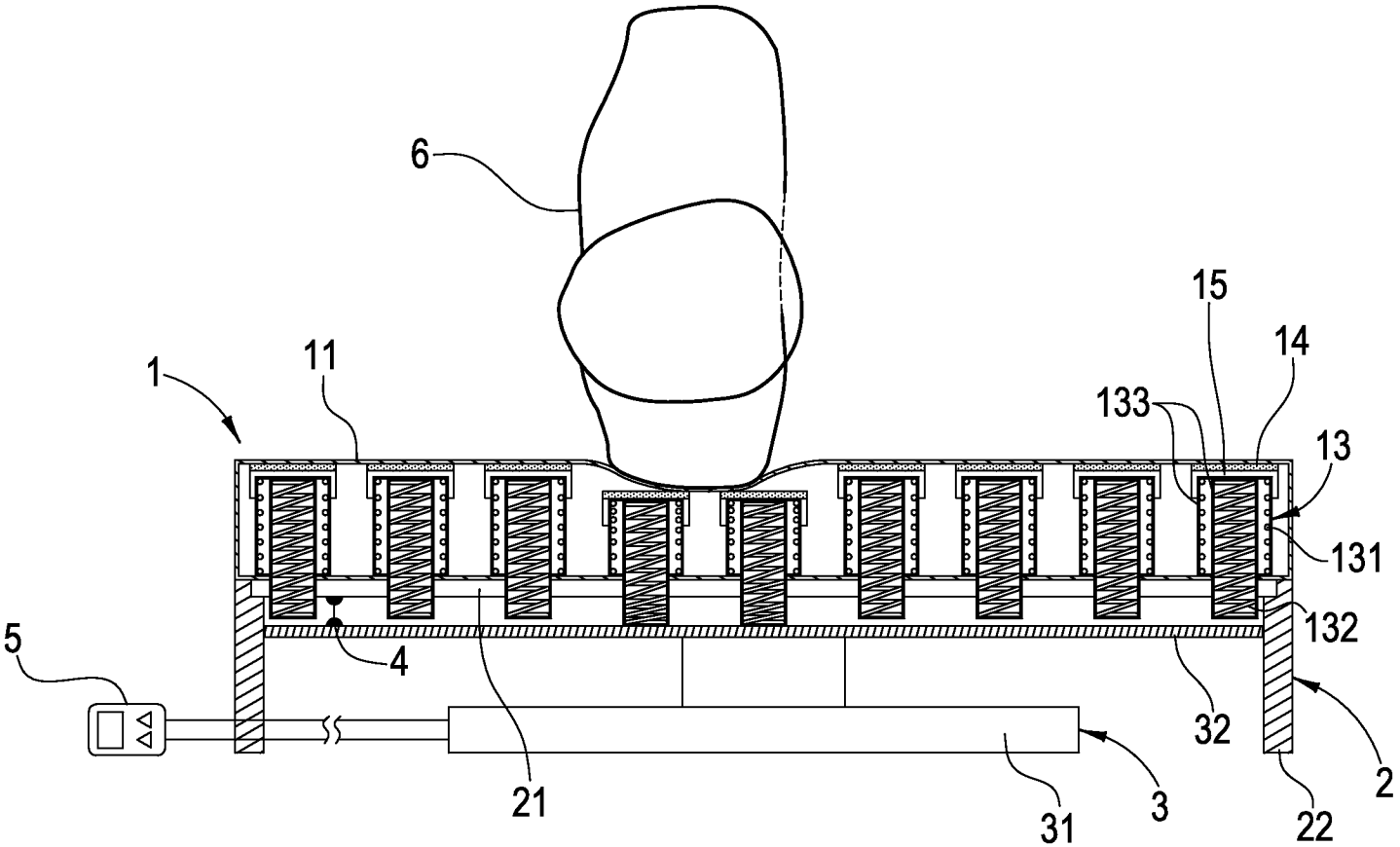
FIG. 6 illustrates a schematic operating view of the method for automatically adjusting the hardness of the mattress based on an operator's lying position or an operator's side lying position and the device thereof of the present invention.

With reference to FIG. 4, which illustrates a schematic block view of a control device of the present invention. The control device 5 at least includes an operating interface 51, a central process unit 52, a display interface 55, a memory unit 54, an activating circuit 53, and a power supply unit 56, the power supply unit 56 provides all power the control device 5 needs for regular operations, the central process unit 52 is electrically connected with the operating interface 51, the gravity sensors 14, the activating circuit 53, and the memory unit 54, the activating circuit 53 is electrically connected with the power output component 32 of the lifting device 3. With references to FIG. 5 and FIG. 6, when the operator 6 lies on the bed surface 11 of the mattress body 1 firstly and the gravity sensors 14 are transversely arranged in the mattress body 1, the touching number of the gravity sensors 14 is more under the condition of a lying position, hence the result of the touching number greater than or equal to a preset value is determined by the central process unit 52, so that the operator 6 is lying on the mattress body 1, meanwhile the operator 6 may have an input or output command to the central process unit 52 via the operating interface 51, continuously the central process unit 52 activates the activating circuit 53 to drive the power output component 32 of the lifting device 3 and the lifting platform 31 going up or down, so that the second flexible member 132 is controlled to produce variable flexible forces. The height value of the height sensor 4 going up or down and all input commands are all determined by the central process unit 52 and then displayed by the display interface 55, and the operator 6 may feel a hardness that is needed. While the adjusting hardness value of the operator's lying position is acquired, the operating interface 51 may inform the central process unit 52, and the central process unit 52 will store the value in the memory unit 54. Following is the set of adjusting hardness of the operator's side lying position. Since the touching number of the gravity sensors 14 is less than the preset value under the condition of the operator's side lying position, the central process unit 52 may have another adjusting value according to such touching number, and store the adjusting value into the memory unit 54.

While engaging in a second operation, the central process unit 52 of the control device 5 determines that the touching number of the gravity sensors 14 is greater, equal to or less than the preset value, and the operator's lying position or the operator's side lying position is thus decided; further, the lifting platform 31 of the lifting device 3 goes up or down to a preset position based on the memory value of the memory unit 54, continuously the second flexible member 132 is controlled as well. Therefore, no matter how the operator is in any position, a best mode for hardness is always approached.

Additionally, the control device 5 is integrated in a remote control, which is electrically connected with the gravity sensors 14, the lifting device 3 and the height sensor 4 via wire or wireless for signal transmission.

Further, the operating interface 51 of the control device 5 is a key set, a touch panel or a knob set.

Further, the display interface 55 is an LCD or LED display.

In addition, the bed surface of the mattress body 1 can be covered a pressure blanket, and the pressure blanket is electrically connected with an electronic device. While the pressure blanket is pressed by the operator 6, the display of the electronic device may show the pressure value of the pressed pressure blanket. Therefore, the operator's waist being supported will be known while the pressure value of the operator's waist is increasing.

Although the invention has been disclosed and illustrated with reference to particular embodiments, the principles involved are susceptible for use in numerous other embodiments that will be apparent to persons skilled in the art. This invention is, therefore, to be limited only as indicated by the scope of the appended claims

What is claimed is:

1. A device for automatically adjusting the hardness of a mattress based on the operator's lying position or the operator's side lying position comprising:

a base, having a plurality of hollow platforms that have a plurality of support legs;

a lifting device, below the hollow platforms of the base;

a mattress body, disposed on the base and comprising a bed surface, a bed bottom, a plurality of flexible support units, and a plurality of gravity sensors, a plurality of through holes being disposed in the bed bottom and corresponding to the lifting device, the flexible support unit being constructed by a first flexible member female-connected with a second flexible member, the two ends of the first flexible member being urged to the bed surface and the bed bottom, the second flexible member being free to go into and get out from the through hole of the bed bottom and being supported by the lifting device, the plurality of gravity sensors being transversely arranged on the top of one of the first flexible members, wherein the first flexible members are arranged transversely; and a control device, connected with the lifting device and the plurality of gravity sensors, wherein the control device determines whether the touching number of the gravity sensors is greater, equal to or less than a preset value or not and judges an operator is on his lying position or side lying position, therefore automatically drives the lifting device to an upper preset position or a lower preset position, the second flexible member being variable for flexibility according to the position of the lifting device so as to have different flexibilities of the operator's lying position or operator's side lying position.

2. The device for automatically adjusting the hardness of a mattress based on the operator's lying position or the operator's side lying position according to claim 1, wherein the second flexible member of the mattress body has a fixing end and an active end, the fixing end being connected with the top of the first flexible member, the active end being corresponding to the through hole, the second flexible member protruding out the bed bottom through the through hole while the bed surface is pressing down.

3. The device for automatically adjusting the hardness of a mattress based on the operator's lying position or the operator's side lying position according to claim 1, wherein the first flexible member and the second flexible member are wrapped around by a cover layer, the cover layer being made of nonwoven cloth in order to fasten the top of the first flexible member and the fixing end of the second flexible member.

4. The device for automatically adjusting the hardness of a mattress based on the operator's lying position or the operator's side lying position according to claim 1, wherein the lifting device comprises a lifting platform and a power output component, the power output component being able to lift up or lower down the lifting platform, the lifting device being below the mattress body in order to let the lifting platform and the bed bottom of the mattress body be corresponding to each other, hence the second flexible member is supported by the lifting platform immediately while the second flexible member is protruding out the bed bottom.

5. The device for automatically adjusting the hardness of a mattress based on the operator's lying position or the operator's side lying position according to claim 1, wherein the gravity sensor is a membrane switch or a pressure switch.

6. The device for automatically adjusting the hardness of a mattress based on the operator's lying position or the operator's side lying position according to claim 3, wherein the control device at least comprises an operating interface, a central process unit, a display interface, a memory unit, an activating circuit, and a power supply unit, the power supply unit providing all power the control device needs for regular operations, the central process unit being electrically connected with the operating interface, the gravity sensors, the activating circuit, and the memory unit, the activating circuit being electrically connected with the power output component of the lifting device, through the determination of the central process unit, the result of the gravity sensors greater, equal to or less than the preset value being made, hence the operator is on his lying position or side lying position is determined so as to make the activating circuit drive the lifting device up or down.

7. The device for automatically adjusting the hardness of a mattress based on the operator's lying position or the operator's side lying position according to claim 6, wherein the control device is integrated in a remote control, which is electrically connected with the gravity sensors, the lifting device and a height sensor via wire or wireless for signal transmission.

8. The device for automatically adjusting the hardness of a mattress based on the operator's lying position or the operator's side lying position according to claim 1, wherein the top of the first flexible member connecting with the gravity sensor is firstly combined with a positioning cover and the gravity sensor is secondly connected with the positioning cover.

* * * * *